US006547542B1

(12) United States Patent
Körner

(10) Patent No.: US 6,547,542 B1
(45) Date of Patent: Apr. 15, 2003

(54) SERIES FOR COMPRESSED AIR MOTORS WITH TORQUE WHICH CAN BE THEORETICALLY OUTPUT IN A VARIED MANNER AND A METHOD FOR PRODUCING THE INDIVIDUAL COMPRESSED AIR MOTORS OF SAID SERIES

(75) Inventor: Tillman Körner, Zang (DE)

(73) Assignee: Voith Turbo GmbH & Co KG, Heidenheim (DE)

( * ) Notice: Subject to any disclaimer, the term of this patent is extended or adjusted under 35 U.S.C. 154(b) by 0 days.

(21) Appl. No.: 09/581,879

(22) PCT Filed: Oct. 18, 1999

(86) PCT No.: PCT/EP99/07879

§ 371 (c)(1),
(2), (4) Date: Aug. 29, 2000

(87) PCT Pub. No.: WO00/26540

PCT Pub. Date: May 11, 2000

(30) Foreign Application Priority Data

Oct. 29, 1998 (DE) ..... 198 49 805

(51) Int. Cl.[7] ..... F01C 11/00
(52) U.S. Cl. ..... 418/1; 418/9; 418/10
(58) Field of Search ..... 418/1, 9, 10, 39, 418/196, 199, 200, 170, 171; 29/888.023

(56) References Cited

U.S. PATENT DOCUMENTS 2,720,171 A 10/1955 Harrington

FOREIGN PATENT DOCUMENTS

| | | | | |
|---|---|---|---|---|
| CH | 392422 | * | 9/1965 | ..... 418/10 |
| DE | 2016171 | | 10/1970 | |
| DE | 2810516 | * | 9/1979 | ..... 418/200 |
| DE | 43 10 211 A1 | | 3/1994 | |
| EP | 0 843 095 A1 | | 5/1998 | |
| GB | 605104 | | 7/1948 | |
| JP | 5-79465 | * | 3/1993 | ..... 418/200 |

OTHER PUBLICATIONS

Gutbrod, W: Förderstrom von Auss en– und Innenzahnradpumpen In: ölhydraulik und pneumatik, 19 (1975) Nr. 2, S. 97–98, 101–104.

* cited by examiner

*Primary Examiner*—John J. Vrablik
(74) *Attorney, Agent, or Firm*—Randall J. Knuth

(57) ABSTRACT

The invention is relative to a series of gear motors for differing output volumes with at least two gear motors. Each gear motor has at least two intermeshing displacing elements, a first displacing element and a second displacing element in the form of gears. The individual gear motors of the series comprise substantially identical dimensions for the axial interval between the theoretical axes and between the theoretical axes of rotation of the two displacing elements, and a substantially identical gearing width in the form of a substantially identical axial extension of the gearing elements. The individual gear motors differ from each other at least as regards the size of the tip circle diameter of at least one of the two displacing elements.

8 Claims, 6 Drawing Sheets

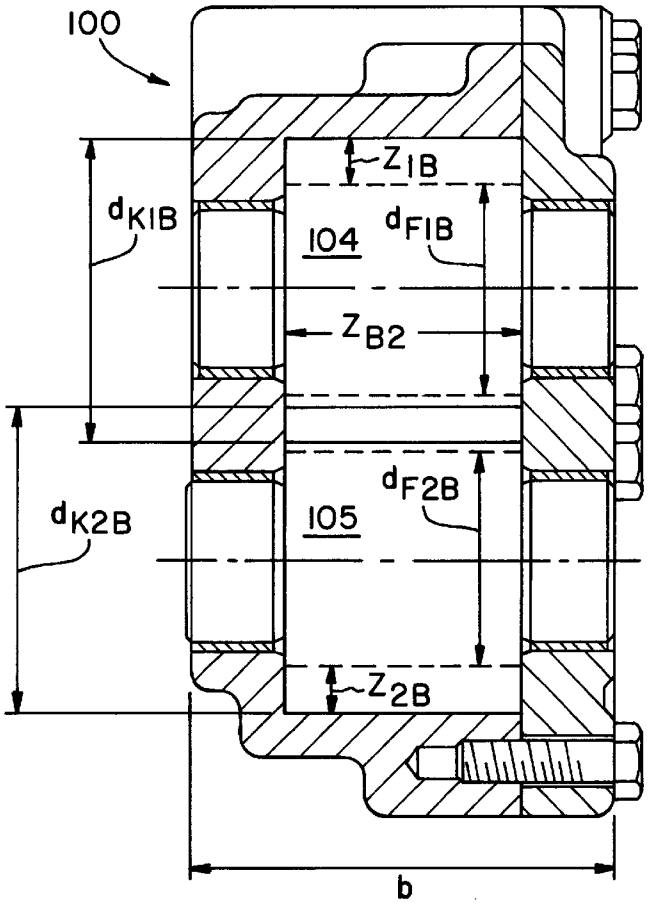
Fig. 1b2
Fig. 1b
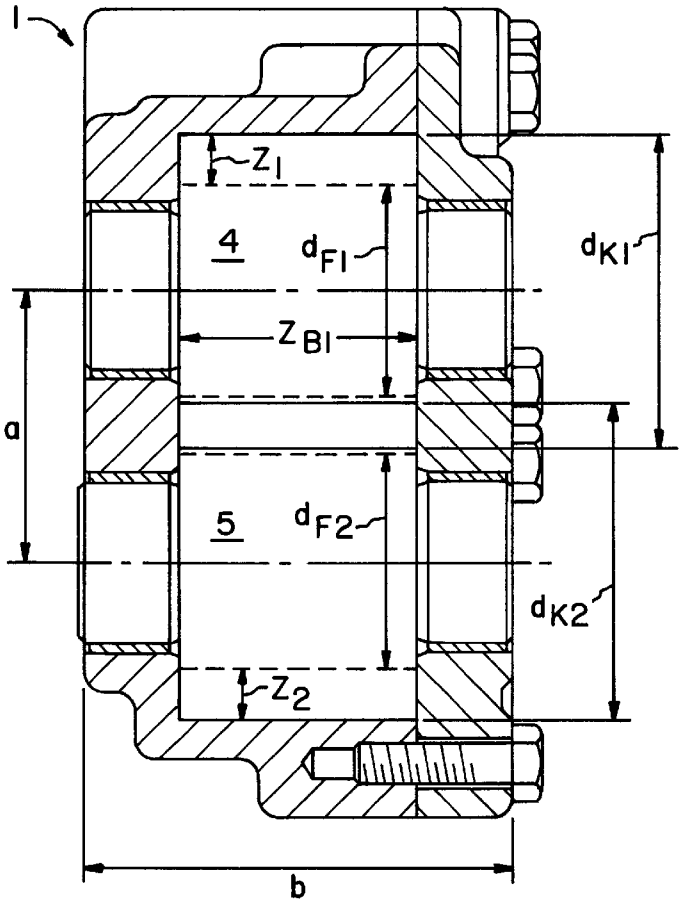
Fig. 1b1

SERIES FOR COMPRESSED AIR MOTORS WITH TORQUE WHICH CAN BE THEORETICALLY OUTPUT IN A VARIED MANNER AND A METHOD FOR PRODUCING THE INDIVIDUAL COMPRESSED AIR MOTORS OF SAID SERIES

BACKGROUND OF THE INVENTION

1. Field of the Invention

The invention is relative to a series for gear motors with differing theoretically outgoing or delivered torque and to a method of manufacturing the individual gear motors of the series.

2. Description of the Related Art

Hydraulic motors in the form of gear motors that convert the energy impressed on a current of liquid into a rotary movement with a certain torque and in which at least two gears meshing with each other and running with a narrow slot in a housing are used as displacing elements are known. As regards the type of displacing elements, two types are distinguished: gear motors with external gearing or toothing, and gear motors with internal gearing. See also in this connection Dubbel: Pocketbook for Machine Construction, $18^{th}$ edition, H4 to H5.

The main characteristics of hydraulic motors are the theoretically outgoing final torque and the output speed range. However, the geometric displacement volume, absorption volume, and the nominal pressure of hydraulic motors also play a significant part in the selection of individual hydraulic motors. Due to the very different areas of application and requirements of use resulting therefrom, hydraulic motors are offered for different theoretically outgoing or delivered torques. They are offered as a rule, in series, in which the individual hydraulic motors of a series preferably have the same design but can differ significantly from each other in their characteristic values and dimensions and a corresponding increase in theoretically outgoing torque due to a change in the geometric displacement volume, e.g., an increase in absorption volume is associated with an enlargement of the construction size. An influencing of the displacement volume can be carried out in analogy with the influencing of the output volume, equivalent to the displacement volume, in pumps as in W. Gutbrod: "The Output Current of External and Internal Gear Pumps and Its Nonuniformity", German journal: Olhydraulik und Pneumatic 18 (1975) No. 2, pp. 97–104 and others by reducing or enlarging the tip circle of one of the two displacing elements. The enlargement of the possible theoretical geometrical displacement volume takes place thereby, e.g., in rather large intervals in groups and the essential distinguishing feature between the groups resides in the different radial dimensions of the displacing elements and axial interval of the gears. Within the group an elevation of the possible output volume takes place in smaller steps by enlarging the gearing width, that is, the extension of the gearing in axial direction. This has the result that the individual motors in drive [train] lines are not freely exchangeable as a rule if the requirements of use are changed since the latter differ sharply as regards the required construction space and similarities between the individual types can hardly be determined.

The invention therefore has the basic problem of creating a series for gear motors for differing theoretically outgoing lam torques and therewith different geometric displacement volumes that are suitable for different requirements of use in which series the individual motors have as many constructive features in common as possible and differ solely by slight modifications from each other. The hydraulic motors themselves are to be kept as small as possible as regards the required construction space and there should be the possibility of replacement with a hydraulic motor with a greater or lesser geometric displacement volume in hydrostatic systems without the entire drive chain having to be replaced or modified. In particular, modifications by altering the speed of the drive chain should be avoided.

SUMMARY OF THE INVENTION

A series of gear motors for differing theoretically outgoing torques and therewith differing geometric displacement volumes comprises at least two gear motors. Each gear motor comprises at least two gears meshing with one another as displacing elements. The invention provides that each gear motor in the series has the following construction features that are essentially identical as regards the dimension: Axial interval a between the geometric axes of the two gears meshing with one another and of the theoretical axes of rotation of the two gears meshing with one another; and gearing width, that is, extension of the gearing in an axial direction.

That is, there is no difference as regards the axial interval and the gearing width between the individual gear motors.

The differing theoretically outgoing torques and therewith different geometric displacement volumes are adjusted in accordance with the invention in gear motors of a series with the same axial interval between the individual displacing elements and a constant gearing width over the cog height. It is sufficient thereby if at least one of the two gears meshing with one another is changed as regards its tip circle diameter from one motor to the next motor in the series; however, in designs with only two gears meshing with one another it is preferable if the tip circle diameters of both gears are appropriately changed. This is preferably achieved by using a high gearing.

The inventor realized that relatively high output volumes can be achieved when using so-called high gearings since the sensitivity of the displacement volume over the tip circle diameter or the tip circle radius is significantly higher than in the case of normal gearings. Even slight changes in the tip circle are sufficient to achieve a corresponding increase of the output volume. The volumetric increase in radial direction of the individual gear motor in the direction of the geometric axes of the displacing elements, or of the axes of symmetry of the displacing elements is relatively slight. This statement also applies in an analogous manner to a diminution of the tip circle diameter or tip circle radius of an individual displacing element. The axial construction length remains constant for all gear motors of the series. A change of the construction unit size takes place only in radial direction during which only a lesser increase in volume for the entire gear motor construction unit is realized on account of the high sensitivity of displacement volume over the tip circle radius. The uniform axial construction length of the gear motor construction unit makes it possible to replace the gear motor arranged in a drive chain in accordance with the requirements of use on the theoretically outgoing torque and therewith displacement volume with another gear motor of this series that is designed for greater or lesser output volumes without the entire drive chain having to be replaced or readapted to the hydraulic motor to be used.

In an especially preferred embodiment of the gear motor series a constant transverse pitch p is assigned to the particular displacing elements, that is, gears of the individual hydraulic motors in the series, in the case of an axial interval that can be predefined and is constant for all hydraulic motors in the series, that is, the modulus as dimensional factor of the gearing is also constant for all gear motors so that there is the possibility of developing the displacing elements for the individual gear motors with differing output volumes from a motor arrangement with a unified basic displacing element as described, in which the basic gearing is designed for a maximum theoretical displacement volume of at least one of the two displacing elements as a high gearing and for lesser or minimal displacement volume the gearing or the individual gearing elements are reduced in size by removing metal or, in particular, milled down correspondingly to a smaller tip circle diameter. This procedure makes it possible to create a series for gear motors with different displacement volumes which are especially compact and very standardized as regards the individual elements used. The high degree of standardization results in a diminution of the manufacturing cost, which for its part is reflected in the total cost.

The design of the basic construction unit for the maximum theoretical displacement volume and therewith maximum theoretically outgoing torque as regards the individual gears meshing with each other takes place in accordance with the fundamentals for interpreting the geometry of gear pairs. This applies to the general instance that influence is exerted only on the cog height, regardless of the form, and to the especially advantageous embodiment in which, starting from a displacing element designed for maximum displacement volume, lesser displacement volumes can be realized by shortening the cog height, that is, removing material.

The solution of the invention can be used in gear motors with external gearing, and internal gearing. It is immaterial thereby whether the gear motors are single-stage or multistage gear motors.

In gear motors with externally cogged displacing elements, both displacing elements are preferably designed and constructed to be similar in their size and gearing geometry, whereas in the case of dual-stage or multistage gear motors, displacing elements with a differing design as regards geometry and dimensions are used.

The gearing itself is designed as an involute gearing. It should always be taken into consideration thereby that even upon a change of the tip circle diameters between the individual displacement elements of the individual motors of the series a seal is realized between the chamber for the output of displaced operating fluid and the pressure chamber as a result of the contacting of the flanks in order to assure the full functionality of the gear motor.

The solution in accordance with the invention is explained in the following, with reference made to the figures.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein:

FIGS. 1*a*1 and 1*a*2 show by way of example is design of a gear motor of a gear motor series designed in accordance with the invention in two views;

FIGS. 1*b*1 and 1*b*2 show opposing views of two possible designs for gear motors of a motor series designed in accordance with the invention, using a single-stage gear motor with external gearing. FIG. 1*b*1 shows a gear motor for high applied torques and FIG. 1*b*2 shows a gear motor for low applied torques;

DETAILED DESCRIPTION OF THE INVENTION

Figure 1A:
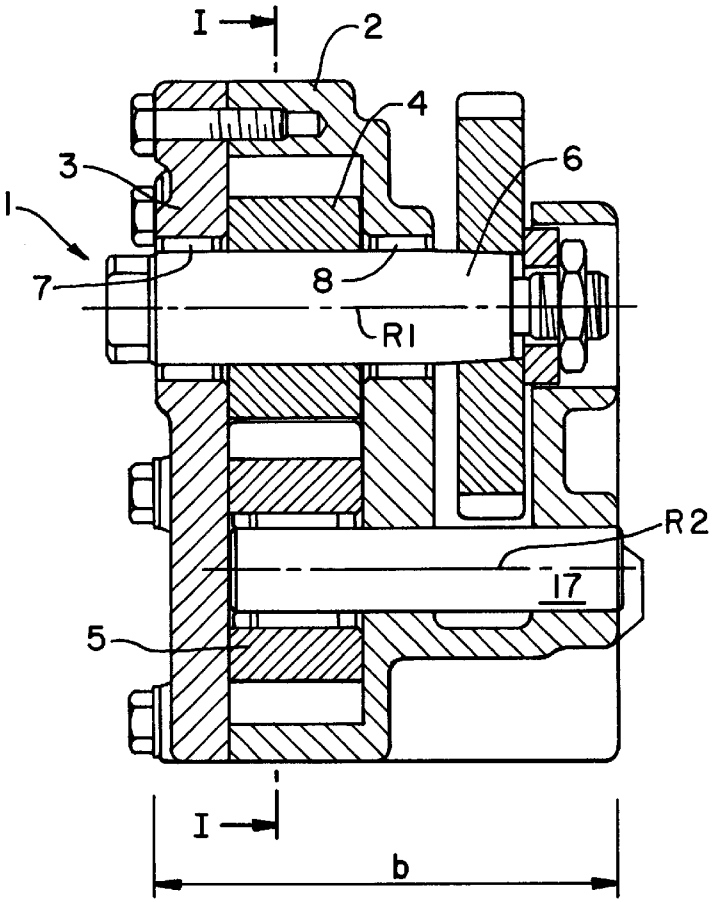
Figure 1A:
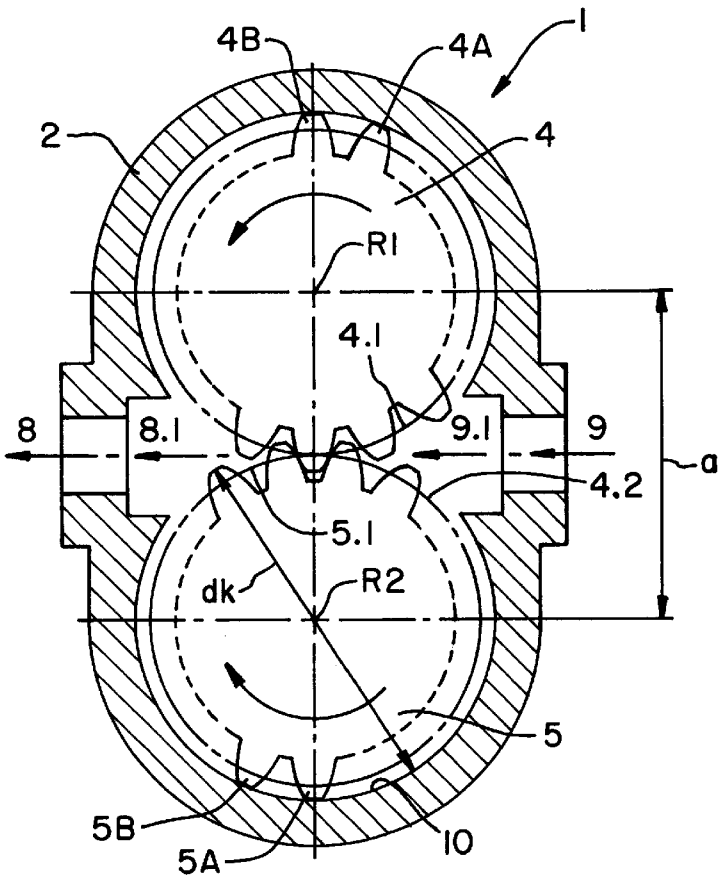

FIG. 1*a*1 shows a section through a gear motor 1 of a series for gear motors designed in accordance with the invention and for differing theoretically torque outputs. This motor comprises housing 2 limited on its front by cover 3. The two displacing elements—a first displacing element 4 and a second displacing element 5, are arranged in the housing. Displacing elements 4 and 5 are designed as externally cogged gears in the form of spur gears meshing with each other. Both run with a close tolerance in housing 2. The first displacing element 4 is mounted on drive shaft 6. Drive shaft 6 is mounted for its part via bearing 7,8 in housing 2 and cover 3 terminating the housing. Moreover, gear motor 1 includes connection 8 for the output of the displaced operating agent and pressure connection 9. Both pressure connection 9 and connection 8 are coupled to corresponding chambers, 9.1 and 8.1. The operating agent passes via pressure connection 9 into the pressure chamber 9.1 and produces a moment on the displacing elements that brings about a rotation of the latter and entrainment of the operating agent (such as hydraulic liquid) between the individual gearing elements. The second displacing element is driven via cog engagement 4/5. The hydraulic liquid is transported to connection 8 in the cog gaps of the displacing elements, cog gaps 4.1 of the first displacing element and cog gaps 4.2 of the second displacing element and removed from there.

In addition, there is the possibility of designing the motor 1 with axial compensation of play. This can take place by a one-sided loading of the bearing of the displacing elements or by loading both sides with operating pressure. This has the advantage that the axial play of the individual gears can be reduced in a pressure-dependent manner.

The theoretical torque produced, that can be adjusted as a function of the displacement volume, is described in accordance with the invention by the displacement volume formed by the individual gearings of displacing elements 4 and 5 and of inner wall 10 of housing 2 and by the pressure of the operating agent on the pressure connection, that is, by the so-called cog spaces 4.1,5.1 between two adjacent cog elements 4A, 4B and 5A, 5B of individual displacing elements 4,5 as shown in a non-dimensionally correct manner in FIG. 1*a*1, in view I—I corresponding to FIG. 1*a*2.

Both displacing elements 4,5 are designed identically for the embodiment according to FIG. 1*a*, that is, they have the same geometric dimensions. Axes R1 of rotation and symmetry for displacing element 4 and R2 for displacing element 5 have a certain interval, that is, the axial interval a in the instance shown in FIG. 1*a*1. The extension of the construction unit gear motor 1 in axial direction is characterized by dimension b.

It is apparent from FIGS. 1*b*1, 1*b*2 for a possible embodiment of a gear motor 1 and a further gear motor 100 from the gear motor series of the invention that the interval of the theoretical axes of rotation and axes of symmetry R1, R2, which is also designated as axial interval a, and the axial extension b are identical for both motors. Axial interval a, which is determined as a rule by the interval of the axes on which the individual displacing elements are mounted, can also be understood as the interval between two rotating shafts, as is the case when the second displacing element is connected to a shaft in such a manner that it is adapted to rotate in unison with said shaft. At least the first displacing element is connected to the drive shaft in such a manner that it rotates in unison with it.

The significant difference, between the two gear motors 1 and 100 of the gear motor series, is that the displacing elements have different tip circle diameters. FIG. 1*b*2 shows in this regard a design with reduced displacer or displacement volumes in comparison to gear motor 1 in accordance with FIG. 1*b*1. To this end and, in addition, displacing elements 4,5 for gear motor 1 and 104, 105 for gear motor 100 are designed as a high gearing. The tip circle diameter $d_{K1B}$, $d_{K2B}$, for displacing elements 104 and 105 is less than tip circle diameter $d_{K1}$, $d_{K2}$ of gearing elements 4A, 4B of gear motor 1. Root circle diameters (root diameters) $d_{F1B}$, $d_{F2B}$, $d_{F1}$, $d_{F2}$ for the individual displacing elements 104, 105 and 4,5 of gear motors 100 and 1 are identically designed. Due to the difference in form of cog height $z_{1B}$, $z_{2B}$, $z_1$ and $z_2$ resulting therefrom, different sizes therefore result for the possible displaceable volume between two adjacent cog elements 104A, 104B respectively 4A respectively 4B, and 105A, 105B respectively 5A, 5B at the same axial extension and therewith gearing width $Z_{B1}$ and $Z_{B2}$.

The design shown with two identically designed displacing elements 4,5 respectively 104 and 105, represents an especially preferred design. This design makes it possible, starting with a gear motor design with displacing elements 4,5 in accordance with FIGS. 1*a* and 1*b*, to develop displacing elements 104, 105 of gear motor 100 by means of a simple working of the displacing elements. This can take place, as already explained, by simply milling down the individual gearing elements and reducing therewith the cog height. The housing must also be provided with a bore or milled out area for the gears.

Figure 5:
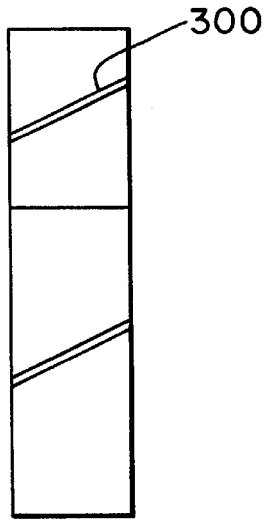

The gearing shown is a straight-cog gearing or radially serrated gearing, i.e., a spur gearing. These gearings are preferably designed as involute gearing. However, it is also conceivable that the gearing of the individual gearing elements can be designed in a manner complementary to each other as a spiral or helical gearing. An example of a spiral gear 300 is shown in FIG. 5. Such a design is distinguished by a very low development of noise at large and small displacement volumes. The face contact ratio and transverse contact ratio obtained is then still more than 2 in both instances.

Figure 2A:
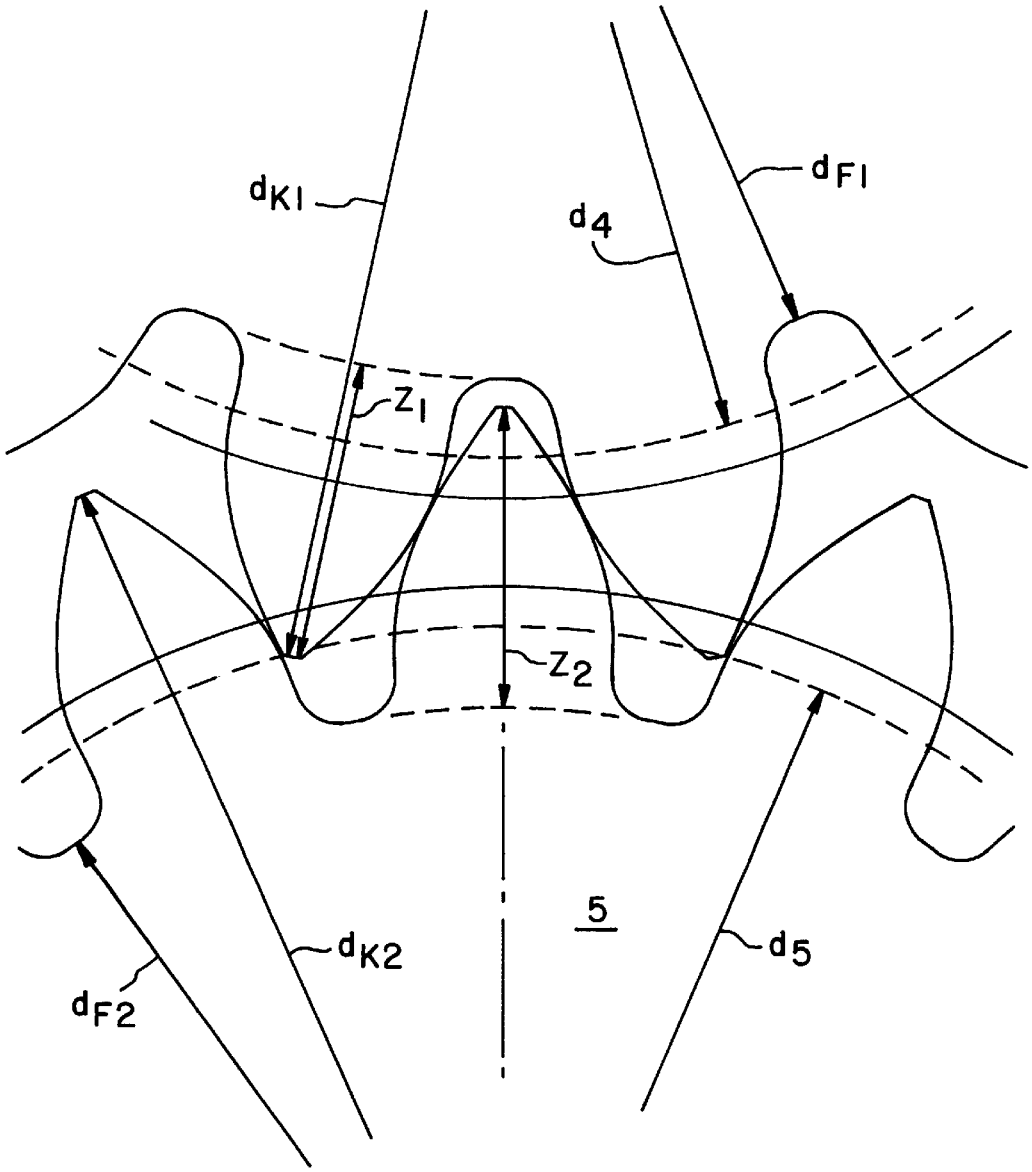
FIGS. 2*a* and 2*b* each show a section of the intermeshing gearing of the displacing elements of the motors shown in FIGS. 1*a* and 1*b*, respectively.
Figure 2B:
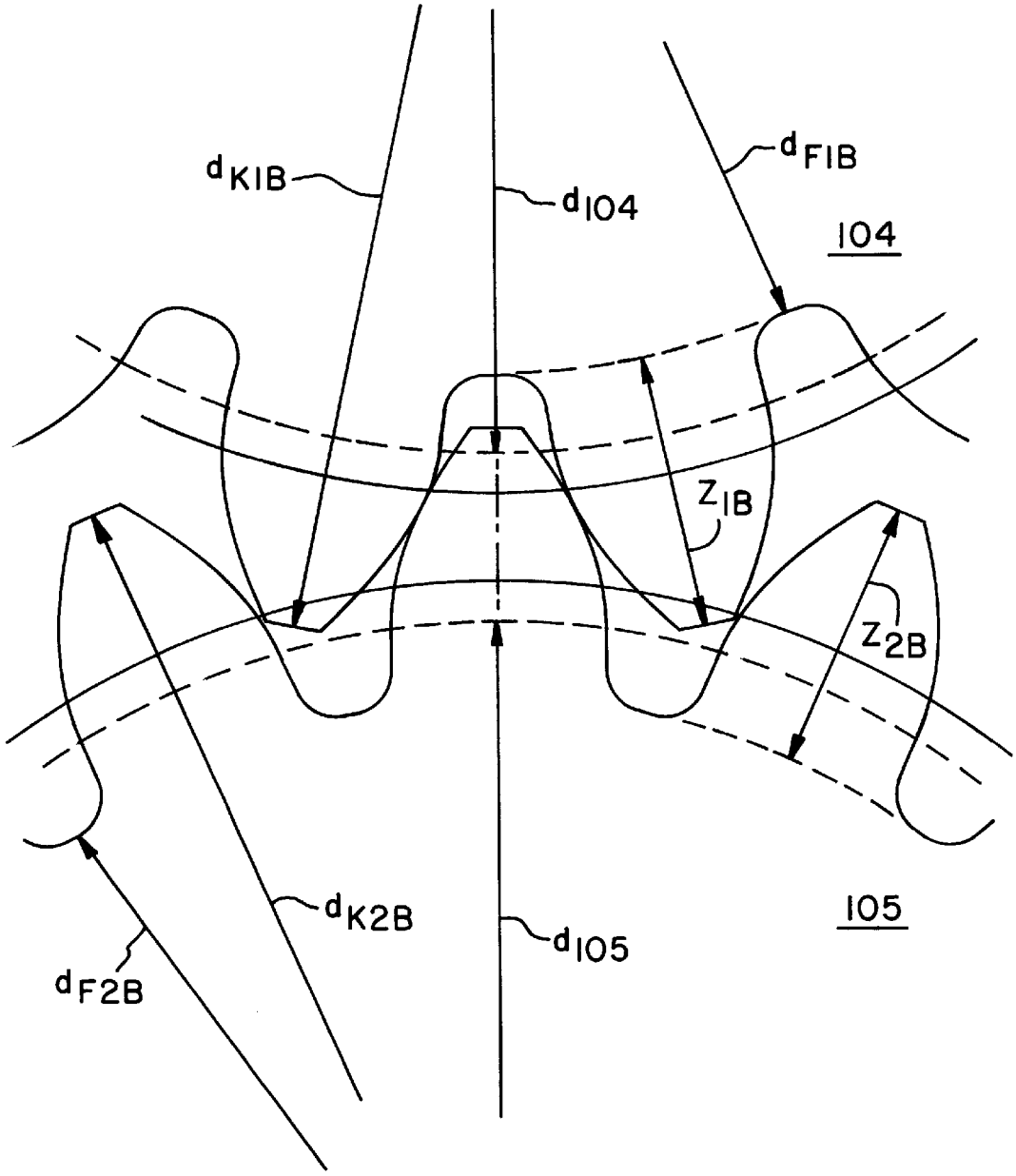

FIGS. 2*a* and 2*b* illustrate sections of an object in FIGS. 1*b*1 and 1*b*2 on an enlarged scale viewed from the right. These latter serve to illustrate the intermeshing of the individual gearing elements of the individual displacing elements 4,5 and 104, 105. For the sake of clarification, the geometric magnitudes for the characterization of a gearing are described once again. Base circle diameters $d_4$, $d_{104}$, are shown as well as tip circle diameters $d_{K1b}$, $d_{K2B}$, $d_{K1}$, $d_{k2}$ and root circle diameters $d_{F1B}$, $d_{F2B}$, $d_{F1}$, $d_{F2}$ and cog heights $z_{1B}$, $z_{2B}$, $z_1$ and $z_2$. The individual displacing elements 4,5 and 104, 105 exhibit an identical pitch p for both embodiments in accordance with FIGS. 2*a* and 1B.

The design of the displacing elements of a motor or a motor series with identical dimensions and with identical geometric design makes possible an especially standardized manufacture of the individual motors of the motor series. The gearings themselves can all be manufactured identically.

Figure 3:
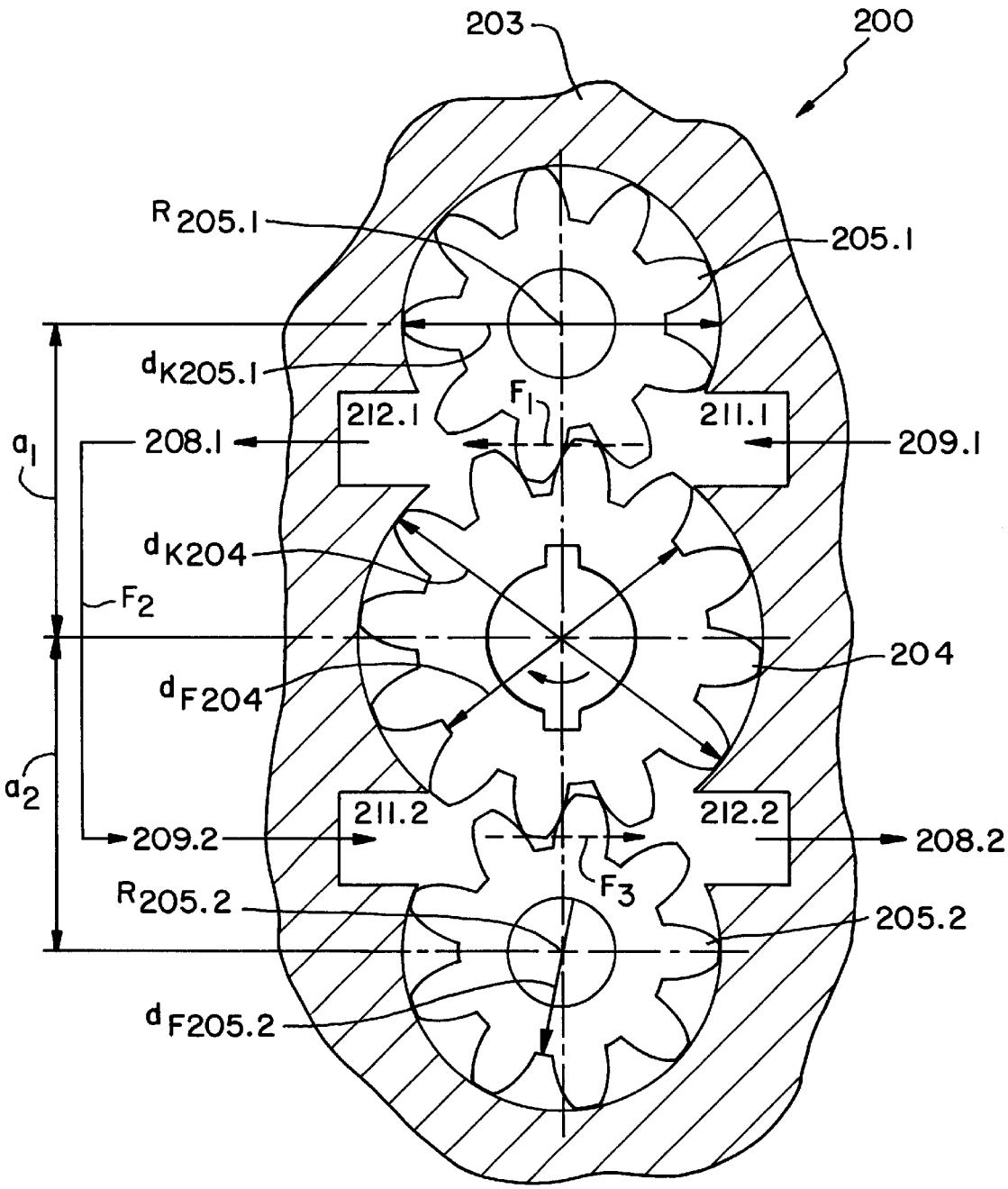
FIG. 3 shows an application of the solution of the invention for multistage gear motors with external gearing.

FIG. 3 shows a view in a sectional representation of gear motor 200 with external gearing in the form of a dual-flow or gear motor. This pump comprises three displacing elements, a first displacing element 204 and two other displacing elements 205.1 and 205.2. The latter are located and mounted in housing 202 with a preferably axially designed housing cover 203. Gear motor 200 comprises two pressure connections 209.1 and 209.2 as well as two pressure connections for the output of the displaced operating fluid 208.1 and 208.2. These connections are connected respectfully to corresponding pressure chambers 211.1, 211.2 and to chambers for the output of the displaced operating fluid 212.1 and 212.2. The chambers for the output of the displaced operating fluid and the pressure chambers are formed in the area of the intermeshing displacing elements. Flow paths F1, F2, and F3 are indicated to show the directional fluid flow within this two-stage system. Displacement elements 204, 205.1, and 205.2 function as drive elements. Displacement elements 205.1 and 205.2 are mounted on an output shaft in such a manner that they rotate at least indirectly in unison with it. In the instance presented, the displacement elements are designed with different dimensions. In particular, they differ as regards their tip circle diameter $d_K$, the root circle diameter $d_F$ and the base circle diameter d. The two second displacing elements 205.1 and 205.2 are preferably identically designed as regards their geometric dimensions in the axial and radial direction, as shown in FIG. 3. However, designs are also conceivable that have different second displacing elements 205.1 and 205.2. However, the form shown in FIG. 3 is preferably selected since it allows a very high degree of standardization. The direction of passage of the operating agent is indicted by arrows. It is apparent therefrom that two different directions of flow and therewith transport directions are made possible with this gear motor 200; however, the same directions of rotation of the output or power take-off are achieved.

Figure 4:
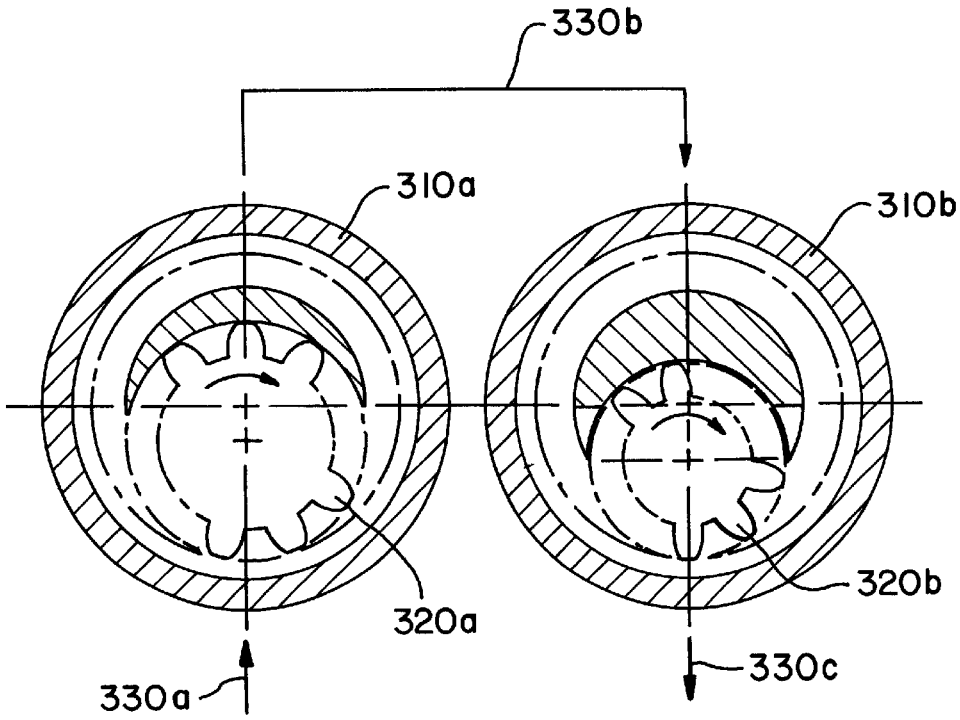
FIG. 4 shows a schematic sectional view of a two-stage motor in which each stage provides an internal gearing and a pinion with external gearing; and Corresponding reference characters indicate corresponding parts throughout the several views. The exemplification set out herein illustrates one preferred embodiment of the invention, in one form, and such exemplification is not to be construed as limiting the scope of the invention in any manner.

In a gear motor series of gear motors with external gearing according to FIG. 3, which series is in accordance with the invention, axial intervals A1 and A2 between the individual gear motors of the motor series are maintained constant and only the gearing height is changed in a manner analogous to that described in FIGS. 1 and 2. As shown in FIG. 4, a two-stage motor instead may include a pair of stages in which a first displacing element is a gear with internal gearing 310 that meshes with a second displacing element that is a pinion 320*a,b* with external gearing. In a manner similar to that shown in other embodiments, pinion (second displacing element) 320*a* is designed to have a different tip circle diameter than that of pinion 320*b*. The individual gear motors of the gear motor series designed in accordance with the invention can thus likewise be developed in a simple manner from a gear motor in accordance with FIG. 3 with a basic configuration for displacing elements 204 respectively 205.1 and 205.2. The individual gearings are also designed as high gearings in this instance too, which has the advantage of achieving the widest possible scatter or spread of the theoretical output volumes while constantly assuring the operation of the gear motor. A seal between the suction chamber and the pressure chamber may also be utilized.

The embodiments shown in FIGS. 1 to 3 constitute preferred embodiments of gear motors of a gear motor series in accordance with the invention. However, modifications that make use of the solution of the invention are also conceivable. The concrete design as a function of the requirements of use is left to the determination of an expert in the art.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A series of gear motors for differing output volumes, comprising:

a series of at least two individual gear motors;

each of said individual gear motors having a housing with at least two intermeshing displacing elements including a first displacing element and a second displacing element in the form of gears located therein;

each of said individual gear motors of said series comprise having substantially identical dimensions for the axial interval between the theoretical axes, and between the theoretical axes of rotation of said at least two intermeshing displacing elements and a substantially identical gearing width in the form of a substantially identical axial extension of the gearing elements; and each of said individual gear motors differing from each other at least as regards the size of the tip circle diameter of at least one of said first displacing element and said second displacing element.

2. The series for gear motors for differing output volumes according to claim 1, in which each of said at least two intermeshing displacing elements of said individual gear motors and/or of said individual gear motors of said series are designed in such a geometrical manner that the gearing can be described by a constant transverse pitch p.

3. The series according to claim 1, in which each of said individual gear motors is designed as a two-stage gear motor, and includes at least a further, third displacing element that meshes with one of said at least two intermeshing displacing elements; and of said at least two intermeshing displacing elements at least two have different tip circle diameters.

4. The series according to claim 1, in which said first displacing element is designed as a gear with internal gearing and said second displacing element is designed as a pinion with external gearing meshing with the latter.

5. The series according to claim 1, in which said first displacing element and said second displacing element are designed as a spiral gears.

6. The series of gear motors with differing output volumes according to claim 1, in which said at least two intermeshing displacing elements are designed as gears with external gearing.

7. The series according to claim 3, in which each of said at least two intermeshing displacing elements of each said individual gear motors of said series exhibit substantially identical dimensions and geometric design.

8. A method of manufacturing gear motors of a motor series comprising:

forming a series of basic gear motor units with a certain axial interval between the geometric axes or the theoretical axes of rotation of at least two displacing elements, with a certain defined axial extension of the gearing and with a certain tip circle diameter of the individual displacing elements, each of said basic gear motor units having a housing wherein said at least two displacing elements are located therein, said basic gear motor units differing from each other at least as regards the size of the tip circle diameter of at least one of said at least two displacing elements; and a motor with a lesser output volume reducing the gearing height by removing material from the basic gear motor unit thereby forming a gear.

* * * * *